US009955849B2

(12) United States Patent
Godehardt et al.

(10) Patent No.: US 9,955,849 B2
(45) Date of Patent: May 1, 2018

(54) DISHWASHER HAVING OPTICALLY DIFFERENTIATED HOLDING SPIKES IN BASKET FOR CLEANING TALL VESSELS

(75) Inventors: Horst Godehardt, Nuremberg (DE); Gerhard Haider, Stockholm (SE); Claudia Hofpeter, Fuerth (DE)

(73) Assignee: Electrolux Home Products Corporation N.V., Brussels (BE)

( * ) Notice: Subject to any disclaimer, the term of this patent is extended or adjusted under 35 U.S.C. 154(b) by 900 days.

(21) Appl. No.: 13/881,953

(22) PCT Filed: Nov. 4, 2011

(86) PCT No.: PCT/EP2011/069440

§ 371 (c)(1),
(2), (4) Date: Aug. 6, 2013

(87) PCT Pub. No.: WO2012/069302

PCT Pub. Date: May 31, 2012

(65) Prior Publication Data

US 2013/0327366 A1 Dec. 12, 2013

(30) Foreign Application Priority Data

Nov. 22, 2010 (EP) ..... 10014820

(51) Int. Cl.
*A47L 15/50* (2006.01)

(52) U.S. Cl.
CPC ..... *A47L 15/503* (2013.01); *A47L 15/505* (2013.01)

(58) Field of Classification Search
CPC ..... A47L 15/505; A47L 15/503; A47L 15/504
See application file for complete search history.

(56) References Cited

U.S. PATENT DOCUMENTS 2,935,207 A * 5/1960 Miller ..... A47L 15/06 134/105
5,205,419 A 4/1993 Purtilo
(Continued)

FOREIGN PATENT DOCUMENTS

DE 1865994 U 1/1963
DE 3510183 A1 * 10/1986 ..... A47G 23/0208
(Continued)

OTHER PUBLICATIONS

English MAchine Translation of JP 2005-185664 (Hideo et al. Jul. 2005).*

(Continued)

*Primary Examiner* — Joseph L. Perrin
*Assistant Examiner* — Irina Graf
(74) *Attorney, Agent, or Firm* — Alston & Bird LLP

(57) ABSTRACT

A dishwasher comprises a basket (10) for accommodating articles to be cleaned, said basket comprising a basket floor and a plurality of holding spikes (30) projecting upwardly from the basket floor, and a rotatable spray arm (12) located below the basket, the spray arm comprising a plurality of spray nozzles (20) oriented to direct water jets towards the basket. In accordance with the present invention the basket (10) comprises at least one fixed holding spike (30) or a fixture (90) for a removable holding spike (92) the placement of which coincides with the path of movement of one of the spray nozzles (20), said fixed holding spike or fixture for a removable holding spike comprising means (36) to optically differentiate the holding spike from the remaining holding spikes.

18 Claims, 5 Drawing Sheets

(56) References Cited

U.S. PATENT DOCUMENTS

| | | | | |
|---|---|---|---|---|
| 5,492,237 | A * | 2/1996 | Chang | A47L 19/04 211/118 |
| 5,794,792 | A * | 8/1998 | Convertino | A47L 15/505 211/12 |
| 7,478,642 | B2 | 1/2009 | Koch et al. | |
| 2002/0074466 | A1* | 6/2002 | Butterfield | B62D 1/184 248/188.5 |
| 2002/0144963 | A1* | 10/2002 | Mood | A47L 15/505 211/85.15 |
| 2005/0109378 | A1* | 5/2005 | Landsiedel | A47L 15/503 134/135 |
| 2006/0254993 | A1 | 11/2006 | Lee | |
| 2006/0289038 | A1* | 12/2006 | Hedstrom | A47L 15/505 134/25.2 |
| 2007/0144985 | A1 | 6/2007 | Kaczmarek | |
| 2008/0308510 | A1 | 12/2008 | Richardson | |
| 2009/0007941 | A1* | 1/2009 | Kim | A47L 15/4234 134/107 |
| 2009/0065455 | A1 | 3/2009 | Miller et al. | |
| 2011/0030742 | A1* | 2/2011 | Dalsing | A47L 15/16 134/198 |

FOREIGN PATENT DOCUMENTS

| | | | | |
|---|---|---|---|---|
| DE | 2946591 | C2 | 8/1987 | |
| DE | 19847151 | A1 | 4/2000 | |
| DE | 19944883 | A1 | 3/2001 | |
| DE | 19947152 | A1 * | 4/2001 | A47L 15/503 |
| DE | 102004008118 | A1 | 9/2005 | |
| DE | 102006012455 | A1 | 10/2006 | |
| DE | 102005061804 | A1 | 6/2007 | |
| DE | 102006007330 | A1 | 8/2007 | |
| EP | 1029502 | A2 * | 8/2000 | A47L 15/502 |
| EP | 1566138 | A1 | 8/2005 | |
| EP | 2067431 | A1 | 6/2009 | |
| EP | 2225996 | A1 * | 9/2010 | A47L 15/14 |
| GB | 2440904 | A | 2/2008 | |
| JP | 2003038410 | A * | 2/2003 | A47L 15/50 |
| JP | 2005-185664 | A | 7/2005 | |
| KR | 2007-0063060 | A | 6/2007 | |

OTHER PUBLICATIONS

Machine English Translation of Description of DE19947152 Al (Kohles, Apr. 2001).*

International Searching Authority, International Search Report for International Application No. PCT/EP2011/069440, 5 pages, European Patent Office, The Netherlands.

Korean Intellectual Property Office, Office Action for Application No. 10-2013-7016153, dated Dec. 11, 2017, 11 pages, Republic of Korea.

* cited by examiner

DISHWASHER HAVING OPTICALLY DIFFERENTIATED HOLDING SPIKES IN BASKET FOR CLEANING TALL VESSELS

CROSS REFERENCE TO RELATED APPLICATIONS

This application is a national stage application, filed under 35 U.S.C. § 371, of International Application No. PCT/EP2011/069440, filed Nov. 4, 2011, which claims priority to European Patent Application No. 10014820.4, filed Nov. 22, 2010, both of which are hereby incorporated by reference in their entirety.

The present invention relates to dishwashers comprising a basket for accommodating articles to be cleaned, said basket comprising a basket floor and a plurality of holding spikes projecting upwardly from the basket floor, and a rotatable spray arm located below the basket, the spray arm comprising a plurality of spray nozzles oriented to direct water jets towards the basket A dishwasher basket usually is provided with a plurality of racks for supporting articles to be cleaned during a dishwashing operation, wherein each rack usually comprises a plurality of holding spikes that are arranged at fixed intervals and which are oriented in generally the same direction.

While the holding spikes of the racks usually are designed to accommodate plates to be cleaned, it is also possible to employ such holding spikes for receiving hollow vessels to be cleaned, such as cups, glasses or bottles. However, particularly with hollow vessels in which the ratio of the height of the vessel to the size of the vessel opening is comparatively large, the cleaning result of such vessel often is not satisfactory because too little water reaches the interior of the vessel.

In view of such deficiencies, several attempts have been made in the prior art to provide for a dishwasher which also provides for a good cleaning result of tall hollow vessels such as bottles and the like.

Thus, in DE 29 46 591 C2 there is described a dishwasher in which a rack assembly is employed which comprises an array of tubes, which also include a plurality of vertical arranged tubes onto which bottles can be placed so as to spray water from inside the bottle onto the bottle walls. The solution suggested in DE 2946591 C2 not only is complicated to manufacture, but also is prone to clogging of the tubes when recirculated cleaning liquid shall be fed through the tubes. Furthermore, such array of tubes cannot be used for the cleaning of other articles such as plates and silverware and hence is not suited for use in common domestic dishwashers.

In DE 1 865 994 U there is suggested a dishwasher which is specifically designed for the cleaning of bottles which can be arranged in a central region of the dishwasher, wherein a rotatable spray arm is provided in the tub of the dishwasher which spray arm is provided with a large amount of spraying nozzles so as to increase the likelihood that one of the water jets ejected from the spray arm reaches a bottle necks and thus sprays water into such bottle. The dishwasher suggested in DE 1865994 U is disadvantageous because on the one hand the central region which is designed for accommodating bottles cannot be used for receiving other articles to be cleaned, and on the other hand because due to the large number of spray nozzles the water can be ejected from the spray arm only with little pressure so that even if a water jet is directed onto an opening of one of the bottles the water jet may not reach the bottom of the bottle, unless an excessive amount of water is supplied to the spray arm which results in an excessive energy consumption of the dishwasher, which for modern dishwashers is prohibitive.

From DE 10 2004 008 118 A1 there is known a dishwasher basket which is equipped with a separate insert which can be arranged at a specific region of the dishwasher basket, which insert is specifically adapted for accommodating bottles. To this end the insert comprises a plurality of openings into which bottle necks can be inserted which openings are provided at locations so as to be directly above the path of movement of spray nozzles which are provided in a spray arm that rotates below the basket. This solution likewise is disadvantageous for several reasons. In particular, since the bottles are not held via holding spikes, but rather by means of circular receptacles, only a single specific size of bottles can be cleaned. Thus, while larger bottles do not fit into the receptacles, bottles which have a smaller neck may protrude too far through the openings so that they would block the rotation of the spray arm that is provided below the basket. In addition, the insert complicates operation of the dishwasher because it comprises a separate part which serves the purpose of fixing bottles but which should be removed from the dishwasher basket when different articles shall be cleaned. In case of non-use, the insert thus has to be stowed away to be reinstalled into the dishwasher basket when again bottles are to be cleaned.

In addition to the above documents, in which attempts were made to improve the cleaning result of tall hollow vessels such as bottles, in some further prior art documents proposals were made for providing for fixations of bottles in dishwasher baskets by which the fixation of the bottle shall be improved.

Thus, in DE 10 2006 007 330 A1 and also in EP 2 067 431 A1 there were suggested dishwasher baskets comprising U-shaped holders which can be fixed to the bottom of the dishwasher basket. While due to the fact that the length of the holder exceeds that of the regular holding spikes, the holder thus may provide for a more stable fixation of a bottle or other tall vessel, the holder cannot guarantee a good cleaning result because no provisions are taken to guarantee that a water jet actually reaches the bottle neck. Thus, if the holder is set at a location into the basket which does not coincide with the path of movement of a nozzle of the spray arm rotating below the basket, the water jets may impinge predominantly onto the exterior side of the bottle and thus may not provide for a sufficient cleaning of the interior of the bottle.

In view of the above disadvantages of the prior art solutions, it is an object of the present invention to provide for a dishwasher which provides for a good cleaning result of deeper vessels, such as tall glasses and bottles, which is easy in handling and use and which nevertheless provides for a high flexibility in use of the dishwasher basket.

In accordance with the present invention the above object is solved by a dishwasher as it is defined in claims 1, 3 and 13. Thus, in a dishwasher which comprises a basket for accommodating articles to be cleaned wherein the basket comprises a basket floor and a plurality of holding spikes projecting upwardly from the basket floor, and a rotatable spray arm which is located below the basket and which comprises a plurality of spray nozzles oriented to direct water jets towards the basket, in accordance with the present invention the basket comprises at least one fixed holding spike or a fixture for a removable holding spike, the placement of which coincides with the path of movement of one of the spray nozzles, wherein the fixed holding spike or fixture for a removable holding spike comprises means to optically differentiate the holding spike from the remaining holding spikes.

The present invention thus provides for a simple and easy-to-use means for cleaning tall vessels, such as taller glasses, bottles, vases and the like, by providing the user of the dishwasher with a clear indication on where to place tall vessels, wherein, due to the fact that the marked holding spike or marked fixture for a removable holding spike is located to coincide with the path of movement of one of the spray nozzles of the rotatable spray arm, it is guaranteed that the water jet ejected from such spray nozzle, during each rotation spray arm, is directed into the opening of the hollow vessel and thus delivers sufficient water so to effectively clean the interior of the vessel.

In the dishwasher suggested herein the holding spike dedicated for cleaning tall vessels either can be a holding spike which is specifically designed or adapted for holding such vessel, or can be one of the "regular" holding spikes of a rack comprising a plurality of holding spikes wherein the dedicated holding spike is provided with a marking to optically differentiate the holding spike from the remaining holding spikes. In such latter example where the marked holding spike belongs to a rack comprising a plurality of holding spikes, the holding spike thus is no special purpose device but rather can be used for example for holding dishes during a washing cycle, but yet can be used in easy manner as fixture for holding tall vessels for which a good cleaning result only can be expected when the vessel is placed directly above one of the spray nozzles.

In embodiments wherein the dedicated holding spike for cleaning tall vessels is a removable holding spike, the fixture can be a specific element that is provided at the floor of the dishwasher basket at a location which coincides with the path of movement of one of the spray nozzles, such as a receptacle for insertion or attachment of a removable holding spike, or, provided that the removable holding spike as such comprises means for secure fastening of the holding spike to the floor of the dishwasher basket, can be a marked site at the basket floor where the removable holding spike can be installed so as to be located directly above the path of movement of one of the spray nozzles.

Preferred embodiments of the present invention are defined in the dependent claims.

Preferably, the spray nozzle the path of movement of which coincides with the fixed or removable holding spike is designed to direct a water jet substantially vertically towards the said holding spike. While spray nozzles often are designed to eject water jets in various directions so as to deliver water through the entire volume of the washing tub, the spray nozzle which passes below the holding spike that is intended for the cleaning of tall vessels preferably ejects a substantially vertical water jet so as to ensure that the water jet reaches the bottom of the vessel also in tall vessels.

The at least one fixed or removable holding spike preferably is adapted to stably support the vessel to be cleaned in an upside-down orientation so that the opening of the vessel is arranged substantially above the path of movement of the said spray nozzle. While thus the said holding spike generally can be a regular straight holding spike as it is usually employed for the fixing of dishes, the holding spike preferably is specifically adapted for supporting hollow vessels in an upside-down orientation, to which end the holding spike can have different dimensions than the remaining holding spikes or can be provided with means for supporting such vessels.

In order to differentiate the said dedicated holding spike from other holding spikes which are not located above the path of movement of one of the spray nozzles, the dedicated holding spike can have a different shape and/or a different length than the remaining holding spikes. Additionally or alternatively, at least part of the said at least one dedicated holding spike can have different surface characteristics than the remaining holding spikes. In order to indicate that a specific holding spike is located directly above one of the spray nozzles of the spray arm, such holding spike thus can have a different colour or surface texture so as to provide the dedicated holding spike with different optics or different haptics than the remaining holding spikes, so as to differentiate the said dedicated holding spike from other holding spikes albeit it may have the same dimensions as the other holding spikes.

In further embodiments the at least one holding spike can be hinged to the basket floor so as to be tiltable between a substantially vertical use position and a substantially horizontal non-use position. Thus, the holding spike which can be either an individual member or can be part of a rack of holding spikes either can be moved into an erect use position or can be laid down onto the basket floor so as to make room for example for larger articles to be cleaned which can be better placed on a flat support such as pots, bowls and the like. It is to be understood that although the holding spike or rack of holding spikes thus also in the horizontal position may provide for a support of articles to be cleaned, in the following description the substantially horizontal position of the holding spikes nevertheless is denoted as a non-use position, so as to differentiate such position from erect positions in which the holding spike can be used to support taller vessels.

In preferred embodiments the at least one dedicated holding spike is provided with a sleeve which covers at least part of the holding spike. Such sleeve can serve a double-function of on the one hand providing for an optical differentiation of the holding spike from other holding spikes which are less suited for the cleaning of tall vessels, and on the other hand can assist fixing articles to be cleaned. Thus, the sleeve can be made of a resilient material, which also facilitates to use the sleeves for retrofitting already existing dishwasher baskets by identifying those holding spikes the placement of which coincides with the path of movement of one of the spray nozzles and marking such holding spike with a resilient sleeve.

The sleeve further can comprise at least one holding projection which laterally extends from the sleeve so as to provide for a more stable fixation of a hollow vessel on the holding spike, so as to avoid or minimize movements and hence possible damage of taller vessels such as glasses, bottles, vases and the like during a washing cycle.

In further preferred embodiments the sleeve can be designed to be axially extendable from the said holding spike, so as to adapt the length of the holding spike to the depth of a hollow vessel to be cleaned.

In the latter embodiments the sleeve further can comprise a stop for limiting extension of the sleeve, so as to make sure that the sleeve is extended from the holding spike only to an extent which still provides for a stable fixation of articles to be cleaned.

The holding spike further can comprise a latching member for fixing the sleeve in either an extended state or in the non-extended state, wherein the said latching member can comprise a thickening, and wherein the sleeve is provided at its inner side with at least one recess for reception of the thickening. In this manner the sleeve can be securely held in its extended state so as to support vessels to be cleaned.

In accordance with a further preferred embodiment, the sleeve can comprise an inner tubular member and an outer tubular member, wherein one of said inner and outer tubular members is telescopically extendable and wherein the other of said inner and outer tubular members is fixed with respect to the basket. Such embodiment is particularly suited for providing a rack having straight, constant diameter holding spikes with one or more extendable sleeves so as to securely hold taller vessels during a washing cycle. Such extendable sleeves likewise can be used for retrofitting existing dishwasher baskets in the manner described above.

In such latter embodiment, in order to secure the relative position of the inner and outer tubular members in an extended state or in the non-extended state, one of the inner and outer tubular members can comprise a thickening and the other of said members can be provided at its inner side with at least one recess for reception of the thickening.

Preferred embodiments of the present invention are described in further detail below by reference to the drawings in which.

Figure 1:
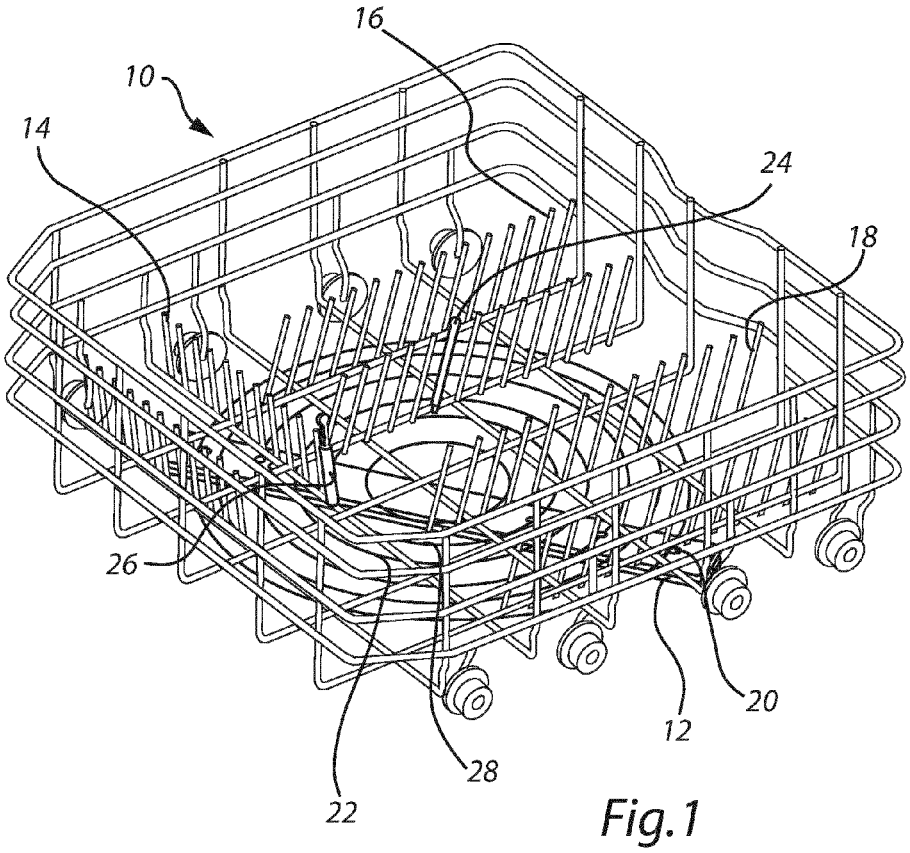
FIG. 1 is a perspective view of a dishwasher basket and a rotatable spray arm.

In FIG. 1 there is shown a dishwasher basket 10 and a rotatable spray arm 12 that is provided below the basket. The basket 10 is a wire mesh basket comprising a plurality of holding spikes which in the embodiment shown in FIG. 1 are provided in three racks 14, 16 and 18 which each comprise a plurality of equidistantly arranged pairs of holding spikes. While in the embodiment shown in FIG. 1 racks 14, 16 and 18 are fixed with respect to the floor of basket 10 each of racks 14, 16 and 18 also may be designed to be tiltable between an upright use position (as shown in FIG. 1) and a folded down position of non-use in which the spikes extend substantially in parallel to the floor of basket 10.

The rotatable spray arm 12 comprises a plurality of spray nozzles 20 which are adapted to spray water upwardly towards basket 10. During rotation of the spray arm which can be effected by providing spray arm 12 with at least one driving nozzle that ejects a water jet at an angle with respect to the vertical direction so as to impart a rotational movement to spray arm 12, each of the spray nozzles 20 moves along a circular path of movement, two of which are shown in FIG. 1 at reference signs 22 and 28. The particular holding spike of rack 16 which during rotation of the spray arm temporarily is located directly above the spray nozzle which moves along circular path 22 is provided with a sleeve 24, so as to indicate to the user that such holding spike is suited for the cleaning of taller vessels, such as tall glasses, bottles, vases and the like. Similarly, one of the holding spikes of rack 14 which is located directly above circular path 28 of a further spray nozzle is provided with a sleeve 26 which in the embodiment shown in FIG. 1 is an extendable sleeve as will be explained in further detail below by reference to FIG. 5.

Sleeves 24 and 26 thus provide for a simple but very efficient means for indicating to the user those holding spikes that are suited for the cleaning of tall hollow vessels, wherein sleeves 24 and 26 do not impart the use of the respective holding spikes for holding other articles such as plates and the like. In the simplest embodiment, the marking of the respective holding spikes can be implemented by providing the respective holding spikes with a different colour so as to differentiate such holding spike from other holding spikes which are located in between or outside of any of the circular movement paths of the spraying nozzles of spray arm 12.

Figure 2:
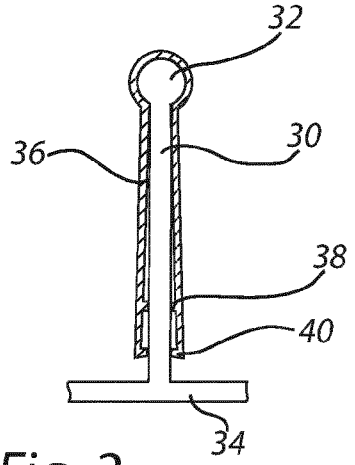
FIG. 2 illustrates a holding spike comprising an extendable sleeve.
Figure 3:
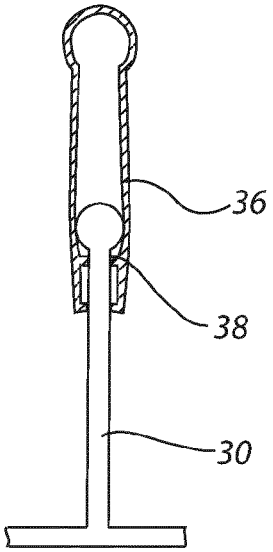
FIG. 3 shows the sleeve of FIG. 2 in its extended state.

FIG. 2 shows a holding spike 30 which comprises a thickened end 32. Holding spike 30 extends upwardly from a base bar 34 which itself either can be fixedly arranged in the floor of the basket 10 or which can be rotatable about the axis of base bar 34. Holding spike 30 is provided with a sleeve 36 so as to differentiate spike 30 from other holding spikes. Sleeve 36 which is made of a substantially rigid or self supporting material, such a plastics material such as polypropylene, is designed to be slightly deformable, so that the interior of sleeve 36 can be widened so as to accommodate the thickened end 32 of holding spike 30 when sleeve 36 shall be moved into an extended position as it is shown in FIG. 3. To this end the sleeve 36 either can be made of a material that is substantially dimensionally stable but allows for a certain amount of deformation, or can be provided with a design that allows a slight deformation along its circumference, such as by providing sleeve 36 with longitudinal slits.

As shown in FIGS. 2 and 3 sleeve 36 comprises in its lower section an upper guiding member 38 and a lower guiding member 40. Upper and lower guiding members 38 and 40 can be designed as a rim which extends inwardly towards the holding spike 30 or as a plurality of at least three projections that are distributed about the inner circumference of sleeve 36. In the extended position shown in FIG. 3, sleeve 36 has been extended until the upper guide member 38 abuts against the thickened end 32 of holding spike 30. In the extended position sleeve 36 can be employed to stabilize taller articles to be cleaned during a washing cycle.

Figure 4:
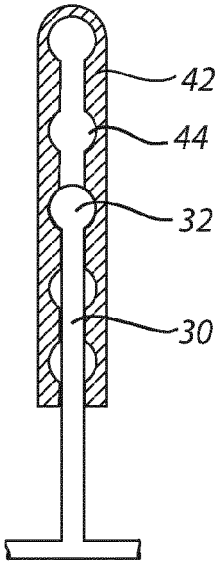
FIG. 4 shows a further embodiment of an extendable sleeve.

In FIG. 4 there is shown a sleeve 42 which at its inner side comprises a plurality of recesses 44 by means of which sleeve 42 can be latched onto the thickened end 32 of holding spike 30 so as to secure sleeve 44 in a non-extended position similar to that of sleeve 36 shown in FIG. 2 or in a fully or partially extended position such as the half way extended position shown in FIG. 4.

Figure 5:
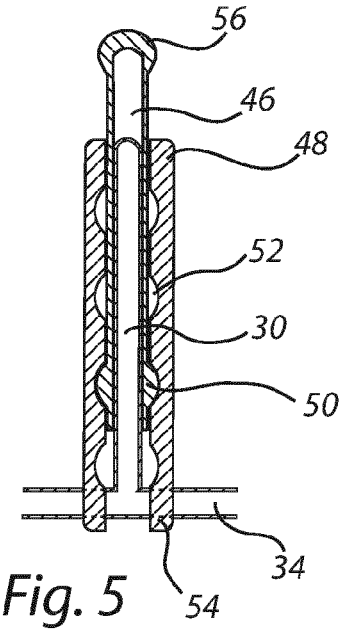
FIG. 5 illustrates a sleeve comprising an inner and an outer tubular member.

In FIG. 5 there is illustrated a sleeve which comprises an inner tubular member 46 that is arranged within an outer tubular member 48. Inner and outer tubular members 46 and 48 are arranged for relative telescopic movement, wherein the inner tubular member 46 comprises one or more projections 50 which engage one of a plurality of recesses 52 provided in the outer tubular member 48 so as to fix the relative position of the inner tubular member 46 with respect to the outer tubular member 48. Outer tubular member 48 at its lower end rests on base bar 34 to which the holding spike 30 is connected, wherein the outer tubular member 48 is provided with a latching projection 54 which extends below base bar 34 so as to fixedly engage the outer tubular member 48 to base bar 34. At its upper end the inner tubular member 46 is provided with a soft tip which can be made for example of rubber and which serves as a rest for articles to be cleaned, such as tall hollow vessels, but also larger plates and the like.

As noted above, sleeve 36 shown in FIGS. 2 and 3 and similarly sleeve 44 shown in FIG. 4 can be made for example of a thermoplastic polymer or of polypropylene or other plastic materials. The sleeves also can be made of hard rubber materials or of combinations of hard rubber materials and plastic materials. Thus for example in the embodiment shown in FIG. 5 the outer tubular member 48 could be made of polypropylene whereas the inner tubular member 46 could be made of a hard rubber material.

Figure 6:
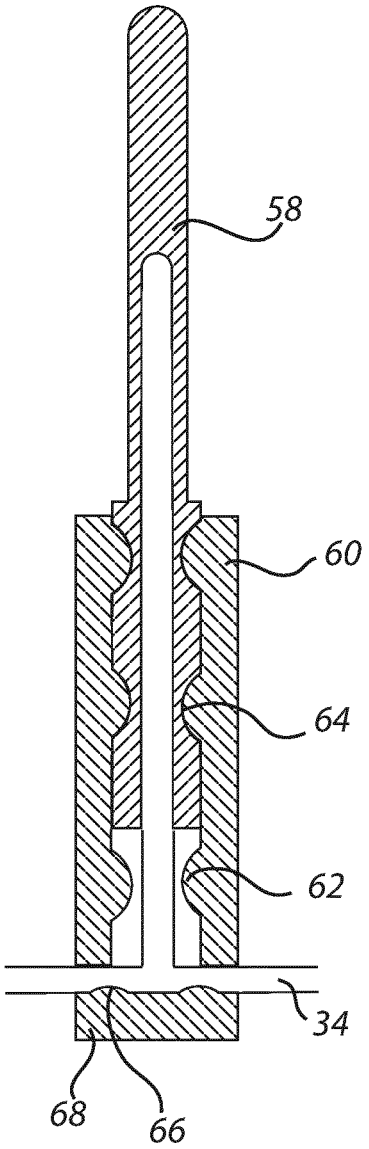
FIG. 6 illustrates a further embodiment of a sleeve comprising an inner and an outer tubular member.
Figure 7:
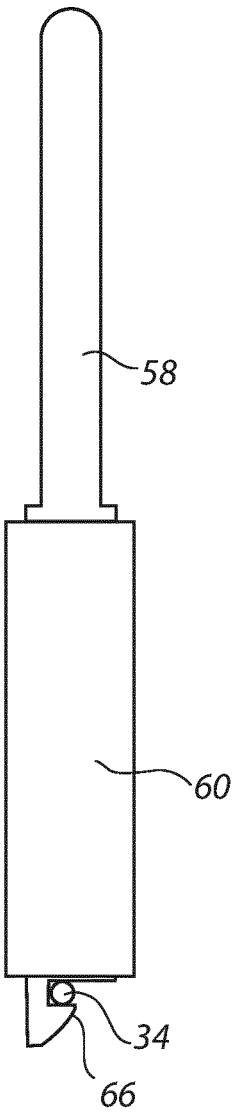
FIG. 7 is a side view of the sleeve shown in FIG. 6.

In FIG. 6 there is shown an embodiment which similar as that of FIG. 5 which comprises an inner tubular member 58 which is arranged to be telescopically extendable form an outer tubular member 60. In order to provide for a fixation of the inner tubular member 58 with respect to the outer tubular member 60, the outer tubular member 60 comprises several projections 62 which project inwardly towards the inner tubular member 58. These projections 62 engage corresponding recesses 64 which are provided at the inner tubular member 58 so as to secure the inner tubular member 58 at any of the extended or non-extended positions. As in the embodiment of FIG. 5, also in the FIG. 6 embodiment the outer tubular member 60 comprises latching members 66 that are provided in a lower section of the outer tubular member 60, which latching members 66 as shown in the side view of FIG. 7 extend downwardly below the base bar 34 so as to fixedly attach the outer sleeve 60 to base bar 34.

Figure 8:
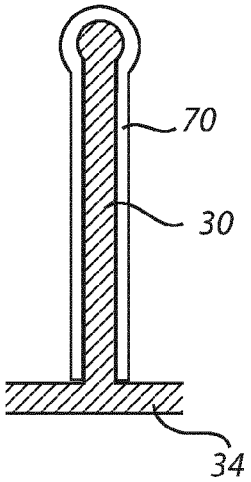
FIG. 8 illustrates a holding spike comprising a fixed sleeve.

FIG. 8 shows an embodiment wherein a holding spike 30 which is located within basket 10 so as to be directly above the path of movement of one of the spray nozzles 20 of spray arm 12 is provided with a sleeve 70 which is made of a resilient material, such as rubber, which has been slit over holding spike 30 so as to differentiate such holding spike from the other holding spikes of basket 10.

Figure 9:
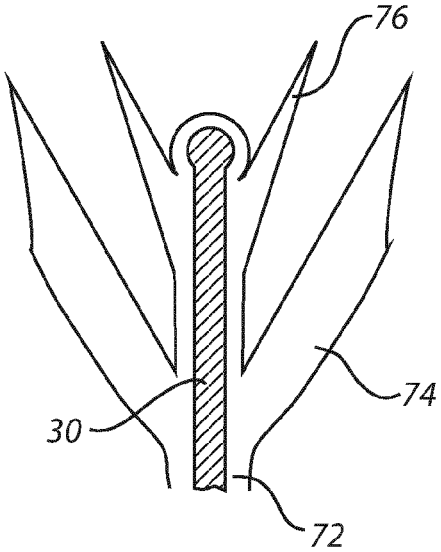
FIGS. 9 to 11 depict embodiments of sleeves comprising holding projections.

In FIG. 9 there is shown a sleeve 72 which comprises a plurality of projections 74 and 76 which are designed to stabilize hollow vessels which are to be held in an upside-down orientation on holding spike 30. Projections 74 and 76 and optionally the entire sleeve 72 is made of a resilient material such as a soft plastic or rubber material so that projections 74 and 76 adapt to the shape of the particular vessel which is put over holding spike 30.

Figure 10:
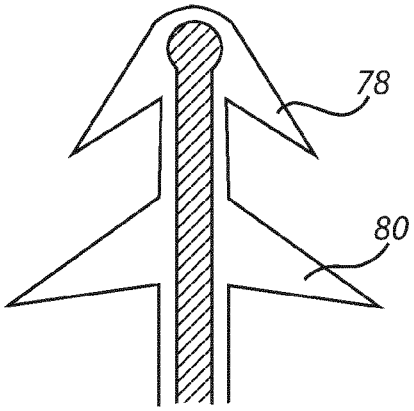

FIG. 10 shows an embodiment that is similar to that of FIG. 9 and which differs from the embodiment of FIG. 9 only in that in the embodiment of FIG. 10 the geometry of the holding projections 78 and 80 is different.

Figure 11:
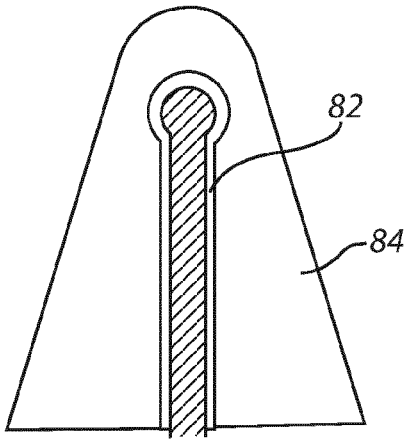

In the embodiment of FIG. 11 the sleeve 82 is provided with a plurality of vertically oriented wall-like projections 84 which are made of a resilient material so as to secure a hollow vessel during the cleaning operation.

Figure 12:
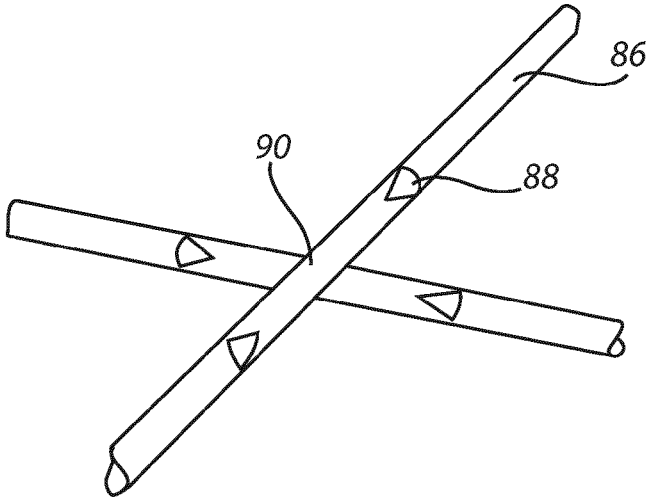
FIG. 12 illustrates a section of a dishwasher basket comprising a marking for reception of removable holding spike.

In FIG. 12 there is shown a section of a floor of a dishwasher basket wherein individuals bars 86 of the basket are provided with markings 88 so as to indicate to the user a site 90 for installation of a removable holding spike, which site is located directly above the path of movement of one of the spray nozzles 20.

Figure 13:
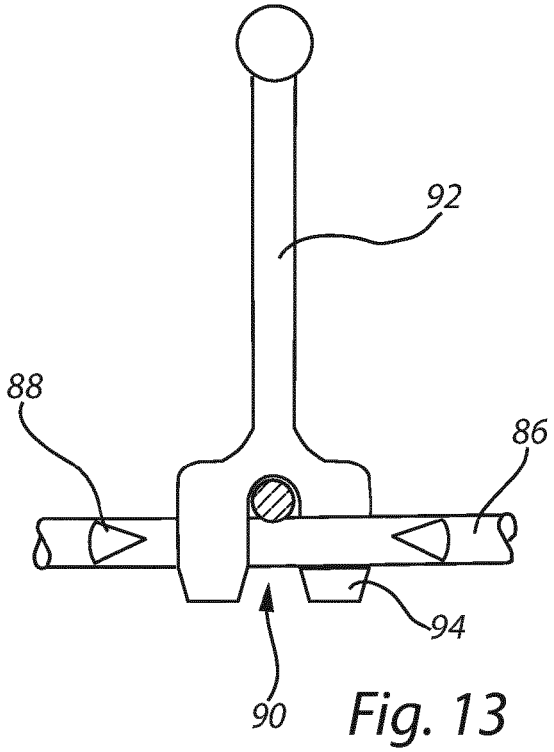
FIG. 13 shows the dishwasher basket of FIG. 12 with a removable holding spike being mounted at the marked site.

FIG. 13 illustrates the dishwasher basket of FIG. 12 with a removable holding spike 92 being mounted at the site 90 marked by the markings 88, wherein holding spike 92 comprises a plurality of latching members 94 that can be snapped onto bars 86 of the dishwasher basket so as to securely fasten the holding spike.

The invention claimed is:

1. A dishwasher comprising:

a basket for accommodating articles to be cleaned, said basket comprising a basket floor comprising a plurality of base bars and a plurality of holding spikes projecting upwardly from the basket floor; and a rotatable spray arm located below the basket, the spray arm comprising a plurality of spray nozzles oriented to direct water jets towards the basket, wherein (a) said plurality of holding spikes comprises at least one first holding spike, said at least one first holding spike being a removable holding spike secured within the basket by at least one latching element secured to at least one base bar of the plurality of base bars, (b) a placement of said at least one first holding spike is substantially above a path of movement of at least one of the spray nozzles, and (c) at least one site for installation of said at least one first holding spike comprises means to optically differentiate said at least one site for installation of said at least one first holding spike from sites of one or more remaining holding spikes of the plurality of holding spikes, wherein the means to optically differentiate said at least one site for installation of said at least one first holding spike comprises a color on at least a part of a surface of said at least one base bar configured to differentiate the placement of said at least one first holding spike from a placement of at least one of the one or more remaining holding spikes.

2. The dishwasher of claim 1, wherein said at least one first holding spike is provided with a sleeve which covers at least part of said at least one first holding spike.

3. The dishwasher of claim 2, wherein the sleeve is designed to be axially extendable from said at least one first holding spike.

4. The dishwasher of claim 3, wherein said sleeve comprises a stop for limiting extension of the sleeve.

5. The dishwasher of claim 3, wherein said at least one first holding spike comprises a latching member for fixing the sleeve in either an extended state or in the non-extended state.

6. The dishwasher of claim 5, wherein said latching member comprises a thickening and the sleeve is provided at its inner side with at least one recess for reception of the thickening.

7. The dishwasher of claim 3, wherein said sleeve comprises an inner tubular member and an outer tubular member, wherein one of said inner and outer tubular members is telescopically extendable and wherein the other of said inner and outer tubular members is fixed with respect to the basket.

8. The dishwasher of claim 7, wherein one of said inner and outer tubular members comprises a thickening and the other of said inner and outer tubular members is provided at its inner side with at least one recess for reception of the thickening.

9. The dishwasher of claim 2, wherein the sleeve is removable from the at least one first holding spike.

10. The dishwasher of claim 2, wherein the sleeve is made of soft plastic or rubber.

11. The dishwasher of claim 2, wherein the sleeve comprises at least one holding projection which laterally extends from the sleeve.

12. The dishwasher of claim 1, wherein said at least one first holding spike is hinged to the basket floor so as to be tiltable between a substantially vertical use position and a substantially horizontal non-use position.

13. The dishwasher of claim 1, wherein at least part of a surface of said at least one first holding spike differs from the one or more remaining holding spikes by at least one surface characteristic.

14. The dishwasher of claim 1, wherein at least part of said at least one first holding spike has a different surface texture than the one or more remaining holding spikes.

15. The dishwasher of claim 1, wherein the at least one of the spray nozzles the path of movement of which coincides with the first holding spike, is designed to direct a water jet substantially vertically towards said at least one first holding spike.

16. The dishwasher of claim 1, wherein said at least one first holding spike is adapted to stably support a vessel to be cleaned in an upside-down orientation so that the opening of the vessel is arranged substantially above the path of movement of said at least one of the spray nozzles.

17. The dishwasher of claim 1, wherein a shape and/or a length of said at least one first holding spike differs from that of at least one of the one or more remaining holding spikes.

18. The dishwasher of claim 1, wherein a shape and/or a length of said at least one first holding spike is substantially the same as at least one of the one or more remaining holding spikes.

* * * * *